US011026459B2

(12) United States Patent
Daigle

(10) Patent No.: US 11,026,459 B2
(45) Date of Patent: Jun. 8, 2021

(54) WIG-MANAGEMENT TEMPLATE-SHIELD SYSTEM AND METHOD

(71) Applicant: Daina Daigle, Iowa, LA (US)

(72) Inventor: Daina Daigle, Iowa, LA (US)

( * ) Notice: Subject to any disclaimer, the term of this patent is extended or adjusted under 35 U.S.C. 154(b) by 42 days.

(21) Appl. No.: 16/514,008

(22) Filed: Jul. 17, 2019

(65) Prior Publication Data

US 2019/0335834 A1 Nov. 7, 2019

Related U.S. Application Data

(63) Continuation-in-part of application No. 14/735,927, filed on Jun. 10, 2015, now abandoned.

(51) Int. Cl.
*A41G 3/00* (2006.01)
*A45D 44/12* (2006.01)

(52) U.S. Cl.
CPC ..... *A41G 3/0075* (2013.01); *A41G 3/0041* (2013.01); *A45D 44/12* (2013.01)

(58) Field of Classification Search
CPC .... A41G 3/0075; A41G 3/0041; A45D 44/10; A45D 44/22; A45D 44/08; A45D 44/12; A45D 44/00; A45D 44/02
USPC ..... 2/202, 424
See application file for complete search history.

(56) References Cited

U.S. PATENT DOCUMENTS 2,294,593 A 9/1942 Bailey
2,445,487 A 7/1948 Lester et al.
2,484,269 A 10/1949 Carlson
3,189,035 A * 6/1965 Heck ..... A41G 3/00 132/201
3,199,516 A 8/1965 Daniel Frishman
3,314,079 A 4/1967 Stout et al.
3,421,521 A * 1/1969 Rich, Jr. ..... A41G 3/00 132/201
3,626,954 A * 12/1971 Ostrom ..... A41G 3/0075 132/201

(Continued)

OTHER PUBLICATIONS

Benita Blocker, 'Hydracap Review: Shrink wrap for deep conditioning!', Apr. 19, 2011, phenomenalhair.blogspot.com/2011/04/hydracap-review-shrink-wrap-for-deep.html.

*Primary Examiner* — Cris L. Rodriguez
*Assistant Examiner* — Brianne E Kalach
(74) *Attorney, Agent, or Firm* — Keaty Law Firm LLC

(57) ABSTRACT

A wig-management template-shield system and method that can be used from the initial measuring and fitting for a wig, as a template, through the wig making and the wig styling processes as both a template and a protective shield for the wig block or wig blocks, and through the use of the wig, including washings and re-stylings, as a protective shield for the wig block or wig blocks, made of a see-through flexible shrinkable barrier sheet material in hood form that is placed over the head of a person to be fitted for a wig in its expanded state as a hood, is shrunk to a shape-conforming envelope retaining the shape of the person's head and hair profile by hot air not causing injury to the person, and is then marked with the location of the person's hairline and other markings, creating a template to be sent to and used by a wig maker to make a proper fitting wig. During the making of the wig and during use of the wig, the template-shield protects wig blocks from damage and staining during dressing and cleaning of the wig.

4 Claims, 6 Drawing Sheets

(56) References Cited

U.S. PATENT DOCUMENTS

| | | | | |
|---|---|---|---|---|
| 4,722,100 | A | 2/1988 | Greer | |
| 5,101,512 | A * | 4/1992 | Weinstein | A41D 3/08 2/174 |
| 5,133,370 | A * | 7/1992 | Duffel | A41G 3/0075 132/201 |
| 5,413,125 | A | 5/1995 | Waranch | |
| 7,069,597 | B2 * | 7/2006 | Hardenbrook | A42B 1/041 2/171 |
| 7,854,025 | B2 | 12/2010 | Spinelli | |
| 2011/0179557 | A1 | 7/2011 | Rabie | |

* cited by examiner

WIG-MANAGEMENT TEMPLATE-SHIELD SYSTEM AND METHOD

CROSS-REFERENCE TO RELATED APPLICATIONS

This application is a continuation-in-part of pending application Ser. No. 14/735,927, filed on Jun. 10, 2015, the full disclosure of which is incorporated by reference herein and priority of which is hereby claimed.

BACKGROUND OF THE INVENTION

This invention provides a wig-management template-shield system and method for use in fitting, dressing, and cleaning of wigs, as a template for wig making and as a protective shield for wig blocks during subsequent use of the wig.

Wigs of human hair or imitating human hair have been known for many centuries, and are still used today, especially in the visual and performing arts. Although mass-designed wigs can be made for informal uses, such as Halloween costumes, wigs for professional uses, such as the visual and performing arts, require some amount of custom fitting to the anticipated wearer of the wig. The location of a person's hairline and the shape of the head are critical information in the making of a wig for professional use.

An actor who is to wear a wig in a performance, if he or she has long hair, will usually gather his or her own hair into a compact clump or bun, contained by a binding such as a section of nylon hosiery, if necessary, and will have a resulting hair profile that includes the gathered and bound hair. This information is also critical for wig making.

Before a wig for an individual can be made by a wig maker, the wig maker needs to know the shape of the individual's head and hair profile, and the location of the individual's hairline. Conveying such information to a wig maker, who might be located at a long distance from where a wig is initially fitted, is often a problem because of errors in taking, transcribing, and transmitting measurements, and errors of translating languages or converting different units of measurement.

Wigs are made on a delicate mesh lace which must be carefully handled and protected from abrasion or pressure. Wig blocks are used, traditionally of cork with a canvas cover. The wig blocks must have a suitable smooth surface in order to avoid damage to the wigs, and if the wig block surface is damaged, the wig block is no longer useable.

The wig blocks upon which wigs are made, dressed, and cleaned are subject to damage and staining from water and the substances and solvents used in making, dressing, and cleaning wigs. At present, many wig professionals use a homemade system of cellophane or plastic wrap secured with tape as protection for wig blocks, but such a homemade system is not durable, is time consuming when done properly, requires frequent re-adjustment and re-covering, and is prone to failure. The wig block used by the wig maker is not necessarily the wig block used by the wig stylist, which is not necessarily used during later cleaning, re-styling, storing, and day-to-day use of the wig. There is therefore usually a need to shield more than just one wig block during the making, styling, maintenance, and use of a wig.

Various different configurations of head caps made of shrink-wrap material have been used outside of the art of wig making, dressing, and cleaning, for enclosing substances close to a person's scalp or for protecting a person's scalp from substances or injury. The existing heat-shrink plastic products are very poorly suited for use for protection of wig blocks because, after shrinking, the plastic has hard, sharp seams and wavy bumps which tend to damage the delicate mesh lace of the wig. Also, existing heat-shrinkable caps or head coverings are too short to cover and protect the lower portion of the wig blocks. If the existing caps or coverings were simply extended downward enough to protect the lower portions of the wig blocks, then after shrinkage they would tend to seal off the nose and mouth of the person inside, causing suffocation, and would tend to contract around the neck, below the chin of the person, possibly causing strangulation, and certainly making the shrunken covering difficult to remove.

What is needed is a combination template and shield that can be used from the initial measuring and fitting for a wig, as a template, through the wig making and the wig styling processes as both a template and a protective shield for the wig block or wig blocks, and through the use of the wig, including washings and re-stylings, as a protective shield for the wig block or wig blocks.

U.S. Pat. No. 2,294,593 issued on Sep. 1, 1942 to Jessie M. Bailey for "Head and Face Protector" discloses head protector for preserving a woman's hair and make-up intact when trying on a garment. The protector consists of a hood formed of one piece of flimsy translucent material. The hood has a seamless front with two side portions; the side portions have upper edges located above the level of the wearer's eyes and connected together in a seam extending rearwardly from the forward and upper portion of the hood. The edges are unattached at the rear so as to form two flaps with tying cords to be extended forward and tied under the wearer's chin.

U.S. Pat. No. 2,445,487 issued on Jul. 20, 1948 to Dorothy Lester et al. for "Head Cover" discloses a bag having front and rear edge seam connected panels with inverted V-shaped notches adjacent the opposite lower ends of the seams. The lower end portions of the panels have horizontal open-ended pockets, and separate drawstrings running slidably through the respective pockets, the free ends of the strings being adapted to be pulled in opposing directions, the opposite ends of said drawstrings being anchored on opposite panels and end portions of the mouth of said bag. The head cover uses open-ended hems or pockets on front and rear panels of the bag-like hood, these serving as pockets for drawstrings. The drawstrings are arranged and anchored on predetermined portions of the panel and at predetermined ends or the pockets. The drawstrings are gathered around the mouth of the hood. Co-acting end portions of the drawstrings are in slidable riding contact in order to apply the pulling strain on the string-ends so as to minimize the likelihood of tearing adjacent areas and regions of the tear-able stock from which the hood is, in practice, made.

U.S. Pat. No. 4,722,100 issued on Feb. 2, 1988 to Barbara J. Greer for "Makeup and Clothing Protector" discloses a substantially flat panel of pliable material having a main panel portion of generally rectangular shape having a front edge and a rear edge. Ties are integrally attached to the rear edge to allow positioning of the protector over a user's head. The ties have a pair of opposing end portions and a central portion, which is fixedly attached to the main panel portion and forming a part of said rear edge of the main panel portion. The main panel portion has a front edge-to-rear edge dimension substantially equal to three times the vertical height of the user's head whereby said main panel portion can be draped over the head with the front edge thereof below the chin and covering the throat, the rear edge behind the neck and the end portions of the ties passing around the neck to gather the lower extremities of the panel and be tied in front.

U.S. Pat. No. 5,101,512 issued on Apr. 7, 1992 to Carol Weinstein for "Disposable Water Impermeable Transparent Personal Body Cover" discloses several embodiments of the cover, including the embodiments for protecting the wearer's head. The cover is constructed of water impermeable transparent sheet material transparent at least over a portion corresponding to the lines of sight of the user, and having perforations to provide ventilation to the user. An endless elastic band—or other type of band—is tensioned about the cover and the head or slipped loosely around the neck of the user to retain the sheet material in position about the head of the user. In one embodiment the band is not endless and is capable of having both ends connected during use as by tying or fastening both ends.

Preferably the cover is formed from a polymeric material, such as transparent flexible plastic material of polyethylene or polyvinylchloride. The ties can be an endless elastic band or two bands dimensioned to be positioned and tensioned about the sheet and the head of the user to retain the sheet in position or, in an alternative embodiment, the retaining means is a separable fastener of the hook and loop-type.

U.S. Pat. No. 7,069,597 issued on Jul. 4, 2006 to Wendy Hardenbrook for "Heat Activated Form Fitting Hair Cap" discloses a heat activated form fitting hair cap designed for substantially sealing an area of a body, such as the scalp, from the environment. The hair cap includes a heat activated shrinkable body having at least one layer of material generally sized to receive a portion of a human head. The cap is bounded substantially by a distal edge. Once the cap is placed on the head, the heat activated shrinkable body may be activated by exposure to a heat source, such as by a hair dryer. Due to its material properties, the heat activated shrinkable body shrinks, thereby reducing the open interior volume, forming a tight fit around the area of the body that is to be enclosed. The cap may also include at least one cap retention means located substantially near the distal edge for ensuring that the distal edge conforms to the head prior to activation and that allows the cap to be adjusted to fit a wide range of head shapes and sizes prior to activation. The retention means may include an elasticized band, a drawstring, or a plurality of ties. To further increase the adjustability of the cap, another embodiment may include a plurality of tear away stress lines that are substantially concentric with the distal edge, thereby imparting adjustability of the volume. In this embodiment, the user may tear away portions of the cap along any of the plurality of tear away stress lines, either before or after shrinking the cap, thereby achieving a custom fit. One primary illustrative use for the cap is for applying hair/scalp care products to the head. As such, the material of the heat activated shrinkable body may be substantially moisture resistant and/or substantially gas impermeable to aid in the hair/scalp treatment. For example, a user may seek to infuse their hair and scalp with a conditioning treatment.

Variations of the cap may incorporate aspects to further retain the heat that is generally lost through the head, such as employing multiple layers of cap material. Such multilayer embodiments may include air spaces and/or infill material between the multiple layers to further reduce heat transfer. The cap may be made from shrink films made essentially of PVC, polyolefin, polyethylene, polyester, nylon, or saran. Additional variations of the heat activated form fitting hair cap may further include methods of introducing treatment fluids directly from the cap, such as including at least one treatment pouch on the inside of the cap housing a treatment fluid. While the description herein focuses on the use of the heat activated form fitting hair cap for applying treatment to the hair/scalp, other exemplary applications include situations wherein it is desirable to keep the hair or scalp dry to reduce the chances of hypothermia, such as during swimming, watersports, or virtually any outdoor activity. Additionally, the cap may be used to protect the wearer from undesirable gripping of the hair or scalp during sporting activities such as wrestling. Further, the cap may be used as a hygienic measure to retain loose hair as may be desired in the medical professions and in the food service industry.

U.S. Pat. No. 7,854,025 issued on Dec. 21, 2010 to Thomas Spinelli for "Protective and Decorative Covering for Sports Helmets" discloses a band having at least a portion composed of a first heat shrink material, the band being sized to cover the sports helmet after an application of heat to the first heat shrink material. The covering can further comprise at least one edge band disposed on an edge of the band, the edge band being composed of a second heat shrink material, the second heat shrink material can have a different shrink rate than a shrink rate of the first heat shrink material. The shrink rate of the second heat shrink material can be greater than the shrink rate of the first heat shrink material. The band can have one or more holes, each of the one or more holes corresponding to a hole in the sports helmet after the application of heat to the first heat shrink material. The covering can further comprise at least one hole band disposed on a periphery of at least one of the holes, the hole band being composed of a second heat shrink material, the second heat shrink material having a different shrink rate than a shrink rate of the first heat shrink material. The shrink rate of the second heat shrink material can be greater than the shrink rate of the first heat shrink material. The covering can further comprise one or more markers for aligning the cover with corresponding markers on the helmet. The sports helmet can further comprise a peripheral groove formed in the outer surface in which is disposed an edge of the covering.

The means can comprise a cutting groove formed in the outer surface for facilitating removal of the covering from the outer surface. The means can comprise one or more removable button snaps.

US Publication No. 2011/0179557 published on Jul. 28, 2011 to Frederick Rabie for "Helmet Pro System" discloses a protective helmet having at least one inner liner for absorbing mechanical energy; and an attachable outer liner comprising shock absorbing material. The protective helmet comprises at least one sports helmet such as those used in contact sports or non-contact sports. The attachable outer liner is applied to an external portion of the protective helmet to provide shock absorption. The shock absorbing material preferably comprises foam or other such deformable material. The outer liner may be adhesively attached to the protective helmet using epoxy. A kit for the helmet liner system may comprise: a protective helmet; a plurality of the attachable outer liner(s); the adhesives such as epoxy and/or glue; and a set of user instructions.

SUMMARY OF THE INVENTION

This invention provides a wig-management template-shield system and method. The wig-management template-shield is made of a see-through flexible shrinkable barrier sheet material in hood form that is placed over the head of a person to be fitted for a wig in its expanded state as a hood, is shrunk to a shape-conforming envelope retaining the shape of the person's head and hair profile by hot air not causing injury to the person, and is then marked with the location of the person's hairline and other markings, creating a template to be sent to and used by a wig maker to make a proper fitting wig. During the making of the wig and during use of the wig, the template-shield protects the wig block or wig blocks from damage and staining during dressing and cleaning of the wig.

The wig-management template-shield of the present invention solves several existing problems of obtaining and transmitting complete accurate fitting measurement to a wig maker, and of providing more secure durable protection for wig blocks by an easier method than loose wrap and tape.

BRIEF DESCRIPTION OF THE DRAWINGS

Reference will now be made to the drawings, wherein like parts are designated by like numerals, and wherein.

DETAILED DESCRIPTION OF THE INVENTION

Figure 1:
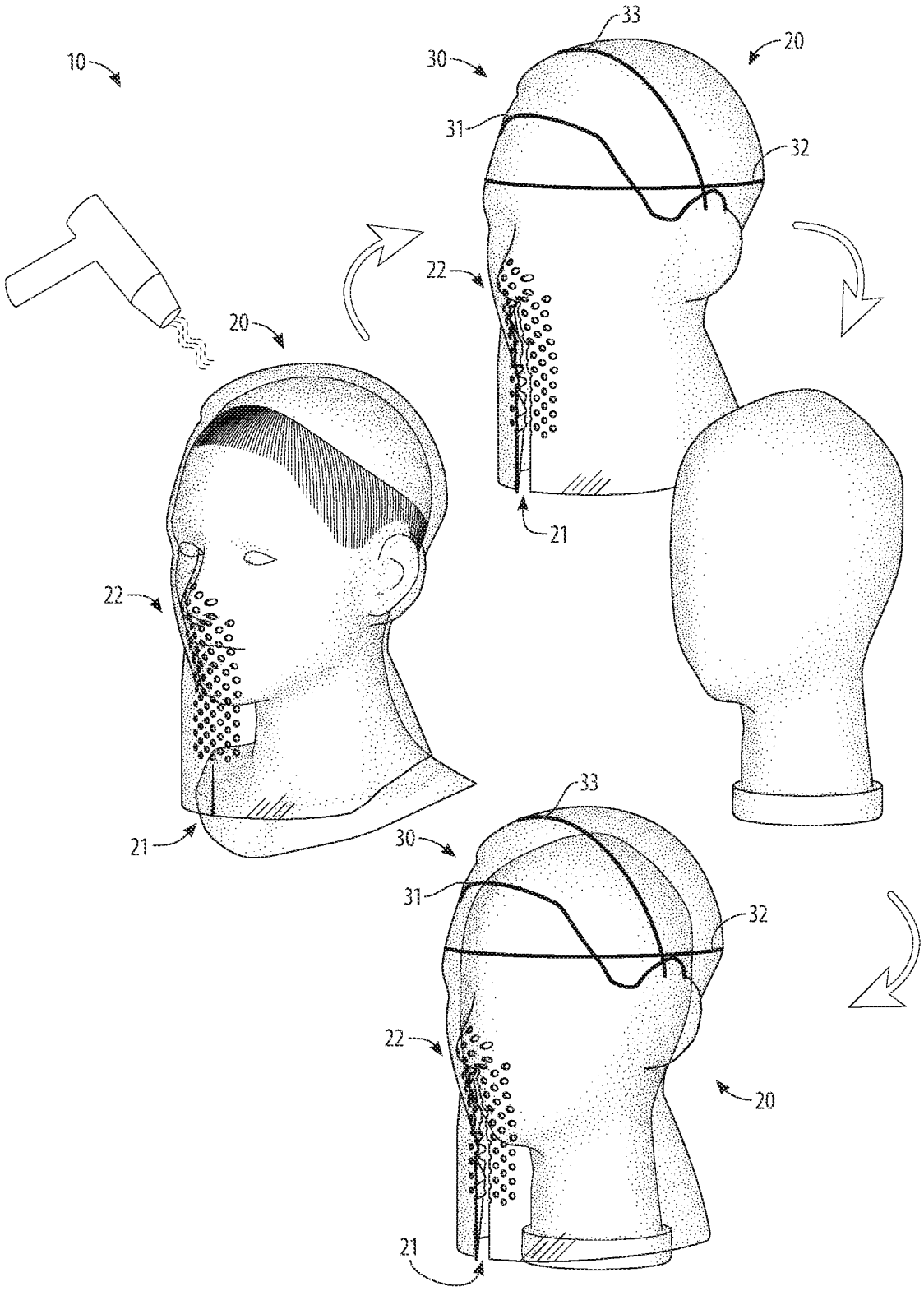
FIG. 1 is a schematic view of the wig-management template-shield of the invention in use.

Referring to FIG. 1, my invention provides a wig-management template-shield 10 providing a seamless heat-shrinkable hood 20 of a flexible, shrinkable barrier sheet material that is placed over the head of a person to be fitted for a wig in its expanded state, is shrunk by hot air not causing injury to the person to a shape-conforming envelope retaining the shape of the person's head and hair profile, and is then marked 30 with a hairline marking 31 of the location of the person's hairline, and other markings, creating a template to be sent to and used by a wig maker to make a proper fitting wig. During the making of the wig and during use of the wig, the wig-management template-shield 10 protects the wig block or wig blocks from damage and staining during dressing and cleaning of the wig.

Figure 2:
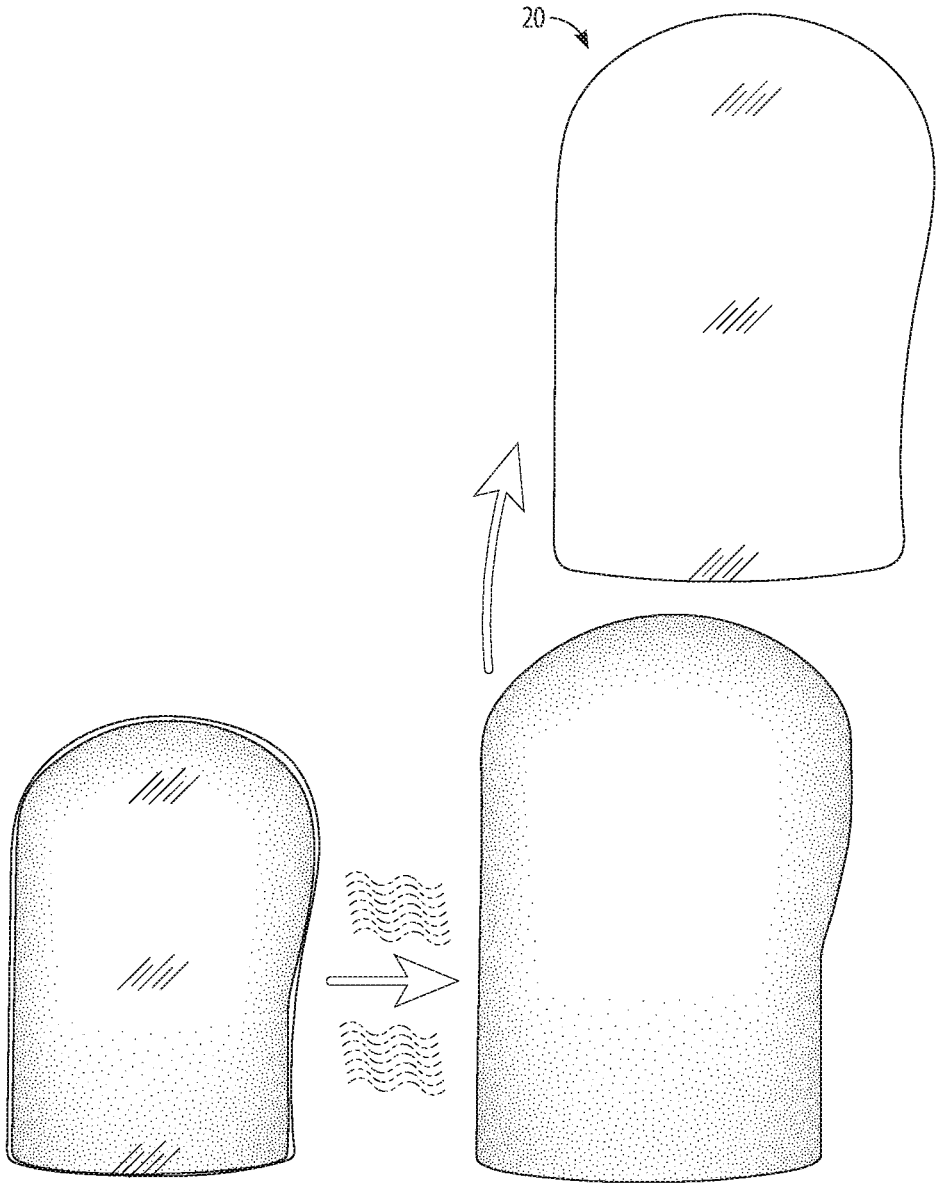
FIG. 2 is a schematic view of the making of the heat-shrinkable hood of the wig-management template-shield of the invention.

Referring to FIG. 2, in a preferred embodiment, the see-through flexible shrinkable barrier sheet material used for the heat-shrinkable hood 20 is a heat-shrink-wrap thermoplastic material exhibiting bidirectional shrinkage upon the application of a moderate and safe level of heated air, an approximate 2:1 shrink ratio, a moderate and safe shrink force, and shape memory sufficient to return to shrunken shape after being slightly stretched during removal and replacement. A hand-held hair dryer of moderately high power produces a stream of air heated to approximately 130° F. (~55° C.), and is safe for brief use on a person. Providing a heat-shrink material which will shrink upon a brief application of approximately 115-125° F. (~46-52° C.) heat will ensure safety and will allow the heat-shrinkable hood 20 to be used with existing hand-held hair dryers already likely in the possession of the wig professionals. Appropriate thermoplastic materials include polyolefins like polyethylene and polypropylene, PVC, fluoropolymers, neoprene, and silicone elastomer. Appropriate production techniques for creating heat-shrink-wrap sheet material having the desired properties from extruded thermoplastic material include cross-linking to create a memory in the material followed by heating, expansion, and rapid cooling. The material also serves as a barrier to water and to the types of substances and solvents used in the making, dressing, and cleaning of wigs. These materials are known in their respective arts.

The material of the heat-shrinkable hood 20 is a see-through material, meaning that it is transparent or semi-transparent. The see-through material should be transparent enough to be able to visually locate the hairline of the person through the hood after shrinking. Such see-through materials are known in the respective art.

The heat-shrinkable hood 20 has the form of an inverted bag or sack, with the closed end at the nominal top and the open end at the nominal bottom. Any hard, sharp, or uneven areas on the heat-shrinkable hood 20 after shrinkage are avoided in order to prevent damage to the delicate mesh lace of the wig or to the wig blocks. The heat-shrinkable hood 20 has no sharp corners which would tend to become hard, sharp, or uneven after shrinkage, but is instead rounded at the top, closed end approximately corresponding to the rounding of the top of a person's head, such that subsequent shrinkage to the person's head yields a smooth surface with no folding or overlapping of material. The heat-shrinkable hood 20 is seamless in order to avoid hard, sharp, or uneven seams after shrinkage. A seamless hood can be made by forming a layer of the material on an expandable anvil, then heating and expanding the anvil, then cooling, and removing the resulting heat-shrinkable hood 20. Later, in use, upon the application of heat, the heat-shrinkable hood 20 will tend to return to the smaller dimensions of the initial forming.

Figure 3:
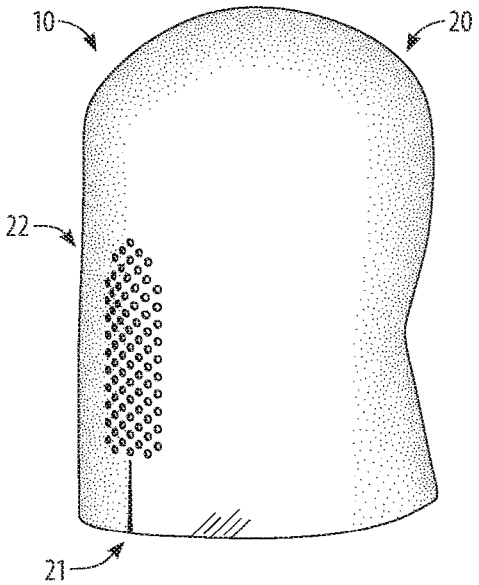
FIG. 3 is a perspective view of the wig-management template-shield of the invention before use.

Referring to FIG. 3, the heat-shrinkable hood 20 is made up in a size appropriate to fit around a human head of large size. A substantially oval form with approximate dimensions of 26.7 in (~68 cm) circumference, 8 in (~20 cm) to accommodate the head horizontally from ear to ear, 9 in (~23 cm) to accommodate the head horizontally from nose to back, and 12 in (~30 cm) vertically, covering the head and neck, substantially to the shoulders, is sufficient to accommodate the largest heads likely to be encountered, where those dimensions correspond to a US hat size of 8.5, where hat sizes of 8 or 8.5 are considered to be very large and are not very regularly manufactured, stocked, and sold. When using a heat-shrink-wrap material having the preferred approximate 2:1 shrink ratio, maximum shrinkage down to a corresponding US hat size of 4.5, corresponding to the size of an infant's head, is possible, and will accommodate the head sizes and head shapes of nearly all of the persons likely to be fitted for wigs.

A hood slit 21 and hood holes 22 are provided in the heat-shrinkable hood 20. Together the hood slit 21 and hood holes 22 allow the heat-shrinkable hood 20 to be sufficiently long to cover and protect the lower portions of the wig blocks, while ensuring the safety and comfort of the person being fitted for a wig. The hood slit 21, running from the bottom edge of the heat-shrinkable hood 20 at a nominal front position, creates a line where the hood can be easily torn, and ensures that the bottom portion of the hood cannot constrict around the neck of the person being fitted for a wig. The hood holes 22 are located above the hood slit 21, also at the nominal front position, a location corresponding to the person's nose and mouth. The hood holes 22 are perforations providing holes for the person to breathe through, and also providing the mesh of heat-shrinkable material around the holes so that the portions of the hood covering the back of the head and the ears will still be pulled into a conforming shape, as opposed to just drawing back as would happen without the connecting mesh. There is no disadvantage if some strands of the connecting mesh stretch to the point of breaking because the area of the hood holes 22 is intended to be cut or torn open for removal of the heat-shrinkable hood 20 from the person's head.

Figure 4:
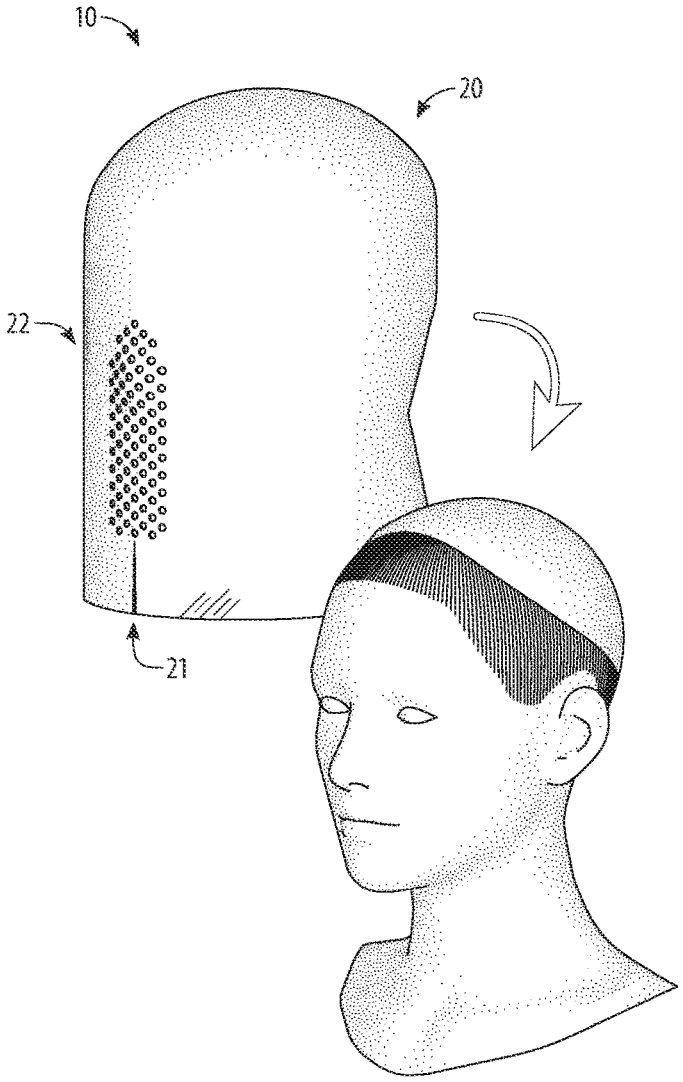
FIG. 4 is a schematic perspective view of an initial step of use of the wig-management template-shield of the invention.

Referring to FIG. 4, the exemplary person is shown with hair pulled up and under a close-fitting cap. A person to be fitted for a wig will have a hairline that varies from person to person and that is critically important in the making of a wig for that person, as the wig will need to either cover that hairline or blend with that hairline. While shorter hair might be worn loose or combed back under a wig, longer hair will generally be consolidated and compacted into one or more curls or a bun, and might be bound up under a cap made of light material such as nylon hosiery, creating a hair profile different than the scalp profile. The size and shape of the hair profile is another critical factor in making the wig. In contrast to, for instance, the circumference of a person's head, which can be expressed as a length-measurement number falling within a fairly narrow range, such as US hat sizes, which are derived from the circumference in inches divided by pi, each person's hairline and hair profile will be different and will be difficult to express or convey in just numbers. The wig-management template-shield 10 becomes conformed to the hair profile, and the hairline marking 31 is traced upon it, so it serves as a template for conveying that information to the wig maker.

Figure 5:
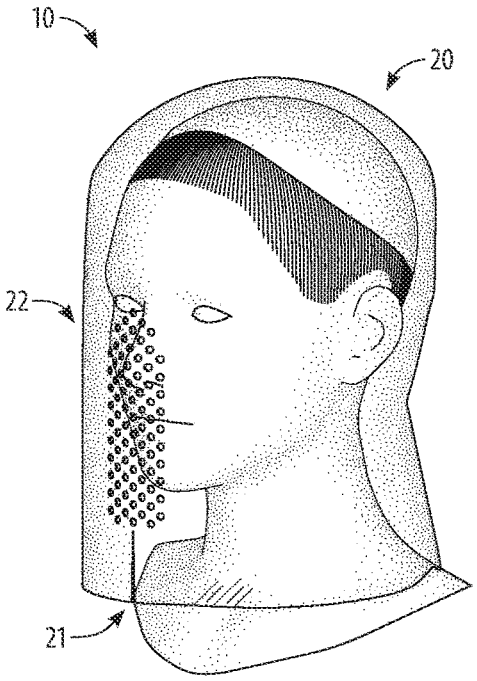
FIG. 5 is a perspective view of the wig-management template-shield of the invention, in use, prior to shrinking.

Referring to FIG. 5, the heat-shrinkable hood 20 is placed over the head of the person to be fitted for a wig, in such a way that the hood holes 22 at the nominal front are positioned to allow the person to breathe.

Figure 6:
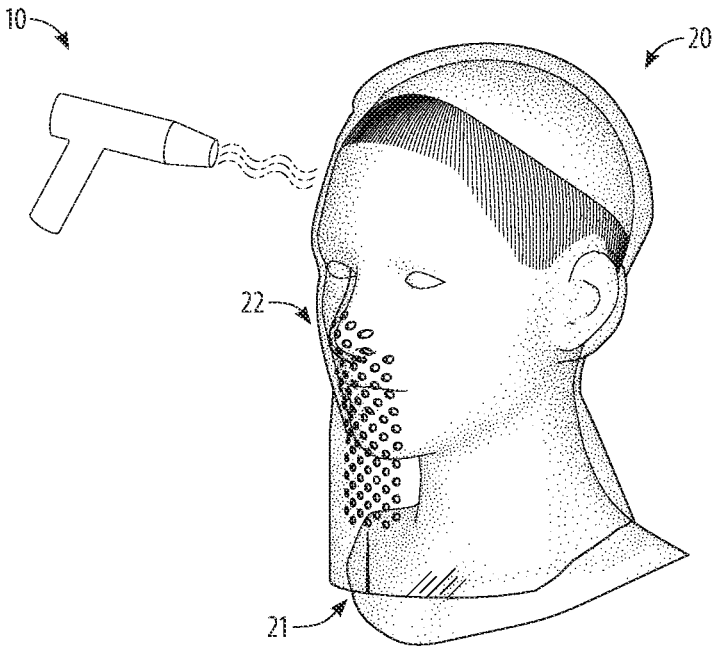
FIG. 6 is a perspective view of the wig-management template-shield of the invention, in use, during shrinking.

Referring to FIG. 6, the heated air from a standard hair-styling blow dryer is blown upon the heat-shrinkable hood 20 in order to cause it to shrink and conform to the shape of the person's head and hair profile. The brief application of blow-dryer heat will not burn the skin, and the material of the heat-shrinkable hood 20 has been chosen to perform with such a safe level of heating, as treated above. The shrunken heat-shrinkable hood 20 now conforms to the shape of the head and the hair profile, and serves as a template for conveying those important shapes to the wig maker. Because the heat-shrinkable hood 20 does not have seams or excess material to create hard or rough areas on the shrunken hood, the mesh lace of the wig can be safely placed upon its surface during the wig-making process and during the subsequent handling and maintenance of the wig.

Figure 7:
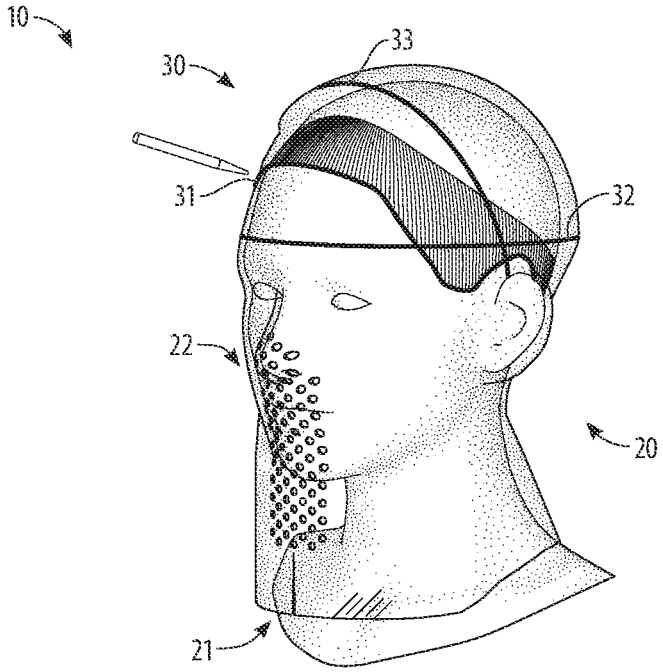
FIG. 7 is a perspective view of the wig-management template-shield of the invention, in use, during marking.

Referring to FIG. 7, after heat shrinking of the heat-shrinkable hood 20, the person's hairline is traced through, and upon, the see-through material of the hood, using a standard marking pen, creating a hairline marking 31. The hairline marking 31 conveys important information to the wig maker which is difficult to convey by other means because, unlike a circumference or hat-size measurement which is always taken at a defined location and can be expressed as a number, the hairline varies from person to person and sometimes from youth to old age. Additional useful markings, such as a circumference marking 32 and an ear-to-ear marking 33 can be made as a supplement to, or in place of, direct measurements of the person's head. The name of the person, and other information such as the production name and the role played, can be written directly onto the heat-shrinkable hood 20. These wig-related markings 30 upon the heat-shrinkable hood 20 serve as a template for conveying the important information to the wig maker.

Figure 8:
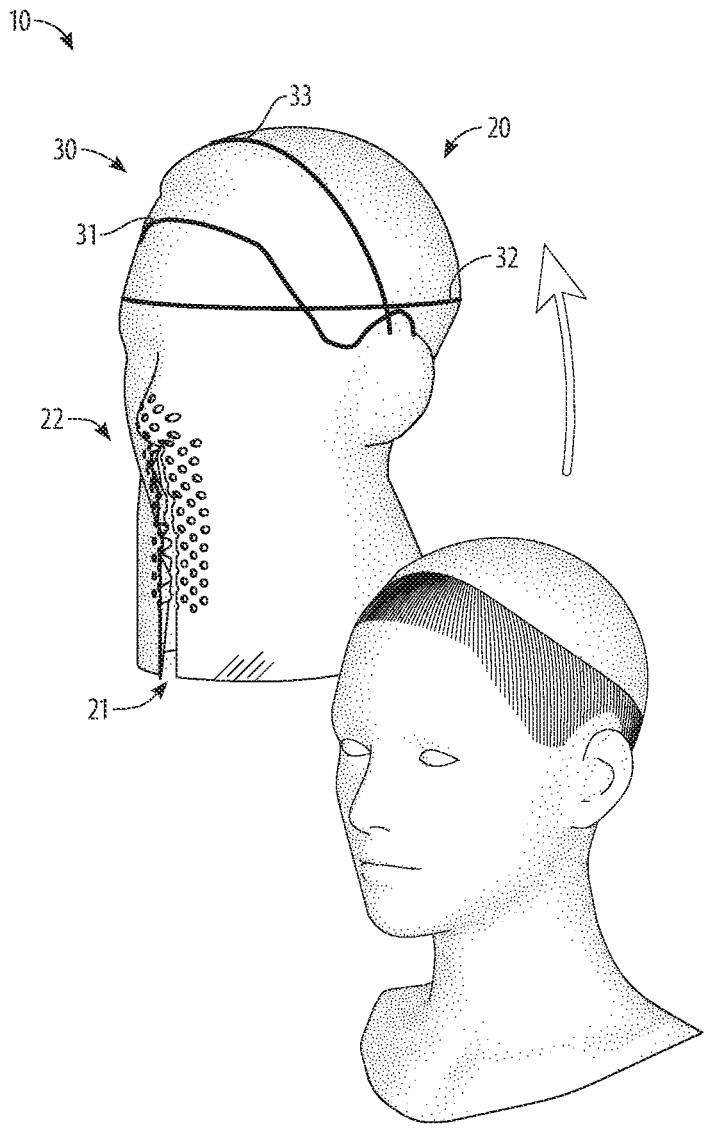
FIG. 8 is a schematic perspective view of an intermediate step of use of the wig-management template-shield of the invention.

Referring to FIG. 8, the shrunken and marked heat-shrinkable hood 20 is removed from the head of the person after extending the hood slit 21 upward through the hood holes 22 by tearing through the perforated area with slight force, making the use of cutting tools near the person's face unnecessary, creating a partial opening. Any resulting roughness or raggedness in that area is not detrimental because no wig is to be placed upon that area corresponding to the person's face.

Figure 9:
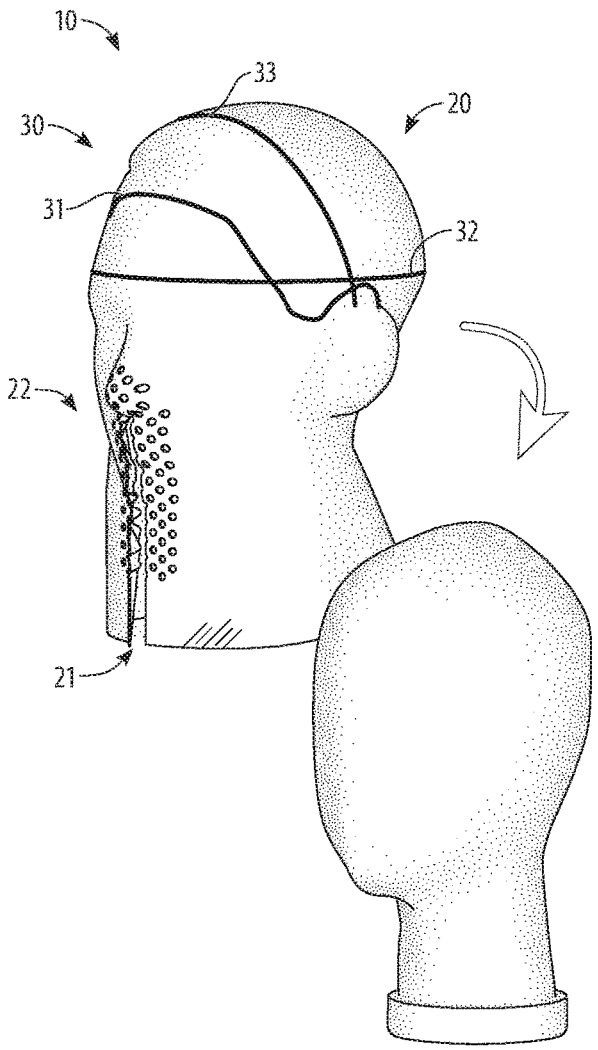
FIG. 9 is a schematic perspective view of a later step of use of the wig-management template-shield of the invention.

Referring to FIG. 9, the shrunken, marked, and partially opened heat-shrinkable hood 20 is placed upon a wig block, initially for use as a template during wig making and styling, and subsequently as a protective shield for wig blocks during cleaning, re-styling, and maintenance of the wig, where the water, solvents, substances, and operations are potentially harmful to the wig blocks.

Figure 10:
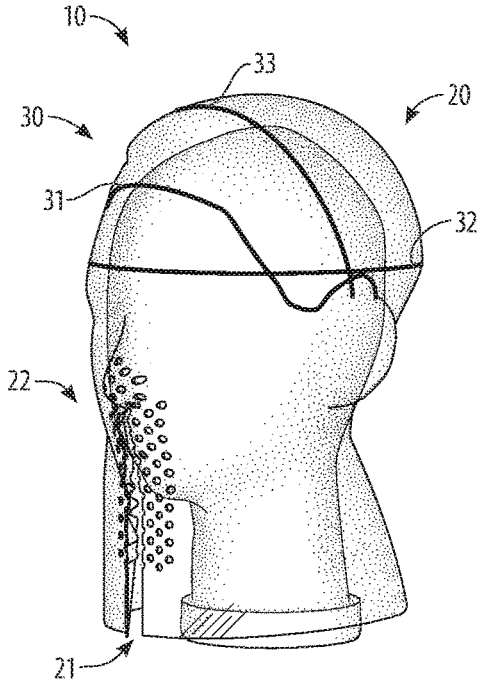
FIG. 10 is a perspective view of a final step of use of the wig-management template-shield of the invention.

Referring to FIG. 10, in use upon a wig block, the wig-management template-shield 10 can be removed and replaced as needed. If necessary, for complete splash protection of the wig block, the torn area of the hood slit 21 and hood holes 22 can be sealed with adhesive tape or by overlapping and wrapping with a waterproof film. Such sealing will not affect the use of the wig-management template-shield 10 because the wig is not placed on that area.

The wig-management template-shield 10 serves as a removable and replaceable template for wig making and protective shield for wig stands during all phases of wig making, styling, cleaning, maintaining, storing, and using the wig. The wig professional who performs the wig fitting might or might not be the wig maker, and the wig maker might be close by or far away. The wig-management template-shield 10, as a shape-conforming envelope retaining the shape of the person's head and hair profile, and having wig-related markings 30 including a hairline marking 31, can easily be conveyed to any local or distant wig maker, with the result that the wig maker gets possession of critical information on a shape-conforming template that the wig maker can work directly upon.

Many changes and modifications can be made in the system and method of the present invention without departing from the spirit thereof. I therefore pray that my rights to the present invention be limited only by the scope of the appended claims.

I claim:

1. A method for wig making and subsequent wig handling, comprising:

(i) providing a wig-management template-shield, comprising:

(a) a heat-shrinkable hood made from a see-through flexible shrinkable barrier sheet material having properties of bidirectional shrinkage at an approximate 2:1 ratio upon application of heated air, of inverted sack form having a closed, rounded top portion and an open bottom end with a nominal front edge, having seamless construction, and having dimensions adapted to fit over a large person's head covering the head and neck to the person's shoulders, adapted to be placed over the head of a person to be fitted for a wig and subsequently shrunken by application of heated air to smoothly conform to the shape of the said person's head, its shape and hair profile, adapted to allow subsequent visual locating and marking of a hairline of the person to be fitted for the wig, and adapted for subsequent placement on a wig block for use as a template and as a protective shield;

(b) a hood slit at the front edge of the open bottom end of said heat-shrinkable hood adapted to prevent constriction of the open bottom end upon shrinkage, and to provide the start of a subsequent larger torn separation along said heat-shrinkable hood; and (c) a plurality of hood holes arrayed upon said heat-shrinkable hood above said hood slit, adapted to provide passage of air for the person to be fitted for the wig while retaining enough structure to support shrinkage of said heat-shrinkable hood;

(ii) placing said heat-shrinkable hood upon the head of the person to be fitted for the wig in such a way as to allow breathing through said hood holes;

(iii) shrinking said heat-shrinkable hood to conform to the head's shape and hair profile of the person to be fitted for the wig, by application of heated air;

(iv) locating the hairline of the person to be fitted for the wig visually through the see-through flexible sheet barrier material of said heat-shrinkable hood;

(v) marking the hairline of the person to be fitted for the wig upon said heat-shrinkable hood;

(vi) tearing said heat-shrinkable hood along said hood slit and said hood holes;

(vii) removing said heat-shrinkable hood from the head of the person who is to be fitted for the wig;

(viii) placing said heat-shrinkable hood, having been shrunken and marked, upon the wig block; and (ix) using said wig-management template-shield as the template for wig making and as the protective shield for the wig block used in the wig making;

(x) using said wig-management template-shield as the template for wig styling and as the protective shield for the wig block used in the wig styling;

(xi) using said wig-management template-shield as the protective shield for the wig block used in subsequent wig cleaning, re-styling, and handling.

2. The method for wig making and subsequent wig handling of claim 1, where said shrinking said heat-shrinkable hood to conform to the head's shape and hair profile of the person to be fitted for the wig, by application of heated air, is accomplished using a standard hair-styling blow dryer.

3. The method for wig making and subsequent wig handling of claim 1, further comprising marking a circumference of the head of the person who is to be fitted for the wig upon said heat-shrinkable hood.

4. The method for wig making and subsequent wig handling of claim 1, further comprising marking an ear-to-ear line of the head of the person who is to be fitted for the wig upon said heat-shrinkable hood.

* * * * *